US005302247A

United States Patent [19]

Richardsen et al.

[11] Patent Number: 5,302,247

[45] Date of Patent: Apr. 12, 1994

[54] TOP CIRCULATION LINE COOLING FOR A MODIFIED COOK DIGESTER

[75] Inventors: Jan T. Richardsen; Victor L. Bilodeau; Mark D. Barrett; Carl L. Luhrmann, all of Glens Falls, N.Y.

[73] Assignee: Kamyr, Inc., Glens Falls, N.Y.

[21] Appl. No.: 970,403

[22] Filed: Nov. 2, 1992

[51] Int. Cl.[5] ..... D21C 7/00

[52] U.S. Cl. ..... 162/42; 162/41; 162/47; 162/249

[58] Field of Search ..... 162/41, 46, 47, 42, 162/249; 165/1, 145, 163

[56] References Cited

U.S. PATENT DOCUMENTS 3,799,256 3/1974 Gaines, Jr. ..... 165/145

5,080,755 1/1992 Backlund ..... 162/41

OTHER PUBLICATIONS

CCPA Tech '91 Kraft Pulping Course, Section III, Modified Continuous Cooking, Apr. 1991.

*Primary Examiner*—W. Gary Jones

*Assistant Examiner*—Dean T. Nguyen

*Attorney, Agent, or Firm*—Nixon & Vanderhye

[57] ABSTRACT

In the production of cellulose pulp (e.g. kraft pulp) utilizing a continuous digester having a number of different feed points for cooking (e.g. white) liquor and utilizing a high pressure feeder, the volume of cool white liquor that is applied to the feed system is reduced compared to conventional processing. This can cause excessive hammering, and damage the high pressure feeder and adjacent piping and equipment. In order to avoid this, liquid being recirculated from the top of the digester back to the high pressure feeder is cooled by passing it into a heat exchanger into heat exchange relationship with a cooler liquid, with the flow of coolant automatically controlled by sensing the temperature of the recirculated liquid. The temperature in the feed system can further be lowered by cooling the cooking liquor before it is added to the pulp slurry, as by passing it to a flash tank so that its temperature is reduced at least 10° C., and the flashed steam can be used in an evaporator.

16 Claims, 3 Drawing Sheets

TOP CIRCULATION LINE COOLING FOR A MODIFIED COOK DIGESTER

BACKGROUND AND SUMMARY OF THE INVENTION

During conventional continuous chemical pulp production, particularly in kraft cooking, the entire cooking liquor (e.g. white liquor) charge is added to the feed system, which includes the high pressure feeder and the circulation line to the top of the digester either with or without an impregnation vessel. However over the last decade two significant advances have taken place in continuous chemical pulp production technology which have changed this. First the MCC TM digesters, and method, developed by Kamyr, Inc. of Glens Falls, N.Y., added white liquor into a central recirculation loop within the digester. Subsequently, EMCC® digesters and processes, also developed by Kamyr, Inc., provided for introduction of white liquor into the bottom (wash) circulation loop. While these digesters and systems have been commercially successful because they enhance the quality of the pulp produced, one unexpected problem resulted from the introduction of the cooking liquor at multiple points, instead of the entire white liquor charge being added to the feed system.

According to the present invention, it has been determined that, in continuous digesting systems where a plurality of feed points for the cooking liquor are provided, since the volume of relatively cool cooking liquor supplied to the feed system is reduced, higher temperatures occur in the top circulation line, i.e. the line returning liquid separated from the chips in the top of the digester to the high pressure feeder (either with or without an impregnation vessel). This increases the potential for hydraulic hammering due to liquor flashing in the line, introducing loading on the adjacent equipment and piping, and providing potential hammering which can damage the high pressure feeder and adjacent piping and equipment. According to the present invention, the temperature of the liquid in the recirculation line, and circulation line, is kept low enough so as to avoid hydraulic hammering due to liquor flashing.

According to the present invention there is provided a method of feeding comminuted cellulosic fibrous material to a continuous digester having a plurality of feed points for cooking liquor, and utilizing a high pressure feeder. The method comprises the following steps: (a) Entraining comminuted cellulosic fibrous material in liquid to produce a slurry, and feeding the slurry to the top of the digester using the high pressure feeder. (b) Adding some cooking liquor to the slurry as part of the liquid entraining the material. (c) Separating some of the liquid from the slurry at the top of the digester. And, (d) recirculating the separated out liquid from the top of the digester to the high pressure feeder. According to the invention, the hydraulic hammering can be prevented when using one or both of the following techniques: the recirculating liquid can be cooled (by passing it into heat exchange relationship with a cooler liquid), and/or the cooking liquor may be cooled before it is added to the slurry (e.g. by flashing the cooking liquor to reduce its temperature, and produce flashed steam which may subsequently be used in an evaporator). If flashing of the cooking liquor is utilized, typically it is flashed when it has a temperature of about 90° C., and the temperature thereof is reduced by at least about 10° C., which can be enough—either singly or in combination with cooling of the recirculating liquid from the top of the digester—to avoid hydraulic hammering. The vacuum required for such flashing is provided through the connections made to the evaporator system.

According to another aspect of the present invention, a cellulosic pulp producing system is provided which comprises the following elements: A substantially upright continuous digester. A high pressure feeder. A circulating line operatively extending from the high pressure feeder to the top of the digester. A recirculating line operatively extending from the top of the digester to the high pressure feeder. A separator for separating liquid from a slurry containing cellulosic fibrous material and liquid, the separator disposed at the top of the digester and connected to the recirculating line. Means for adding cooking liquor to slurry being transported by the high pressure feeder to the top of the digester. And, heat exchanger means operatively disposed in the recirculating line for reducing the temperature of liquid being recirculated from the digester to the high pressure feeder.

The system may also comprise means for sensing the temperature of liquid in the recirculating line, means for regulating the flow rate of coolant to the heat exchanger means (e.g. a valve), and means for controlling the coolant flow rate regulating means in response to the temperature sensing. An impregnation vessel may be disposed in the recirculating and circulating lines between the high pressure feeder and the continuous digester, in which case the heat exchanger means is typically in the recirculating line between the impregnation vessel and the high pressure feeder.

According to yet another aspect of the present invention a cellulose pulp producing system is provided comprising: A substantially upright continuous digester. A high pressure feeder. A circulating line operatively extending from the high pressure feeder to the top of the digester. A recirculating line operatively extending from the top of the digester to the high pressure feeder. A separator for separating liquid from a slurry containing cellulosic fibrous material and liquid, the separator disposed at the top of the digester and connected to the recirculating line. Means for adding cooking liquor to slurry being transported by the high pressure feeder to the top of the digester. And, means for cooling the cooking liquor before supplying it to the means for adding cooking liquor. The cooking liquor cooling means preferably comprises a flash tank, including a steam discharge, and the steam discharge is operatively connected to evaporators.

It is the primary object of the present invention to provide a method and apparatus for avoiding hydraulic hammering or the like in modern continuous digesting systems in which a plurality of feed points for cooking liquor are provided. This and other objects of the invention will become clear from an inspection of the detailed description of the invention and from the appended.

DETAILED DESCRIPTION OF THE DRAWINGS

Figure 1:
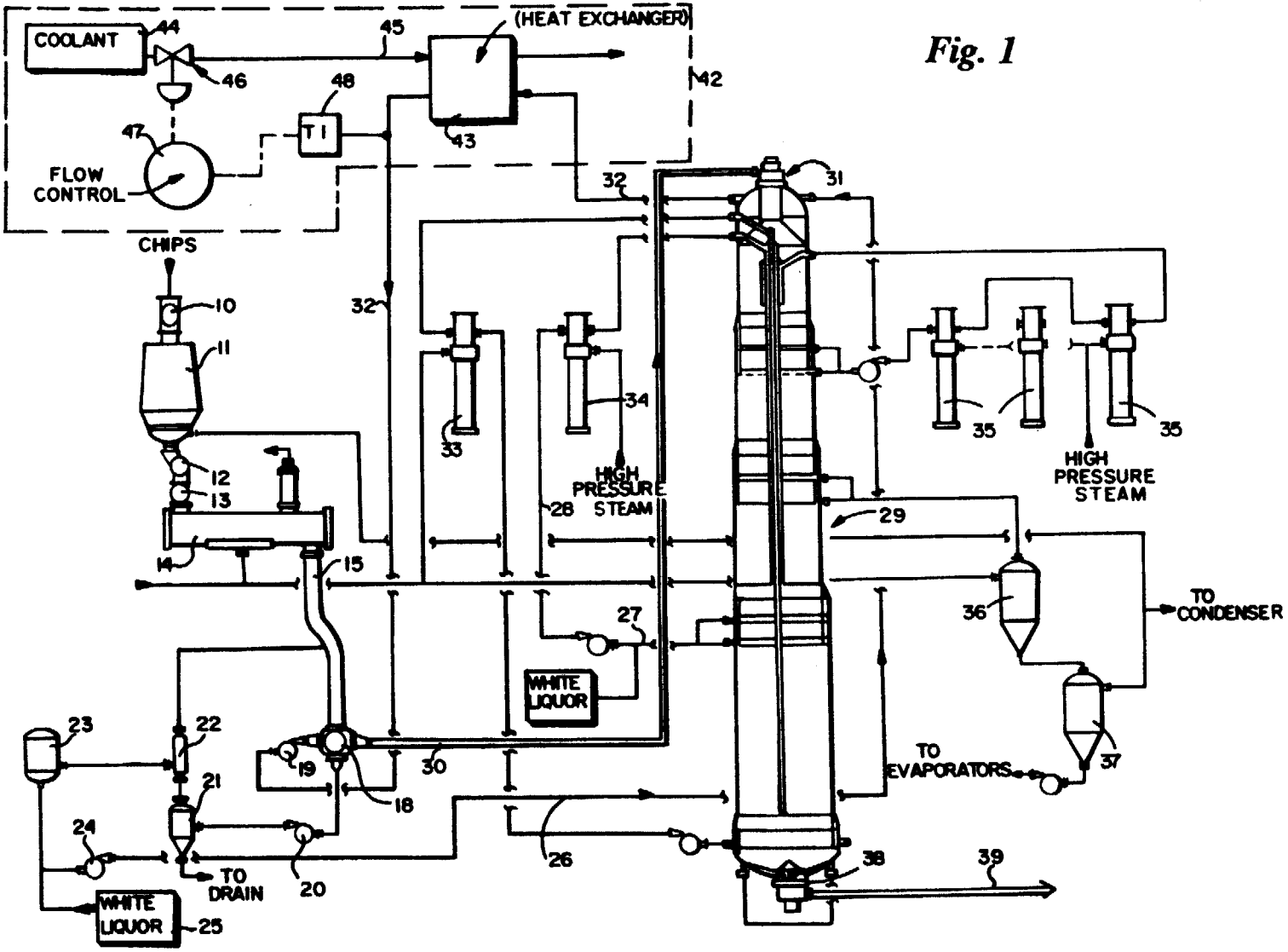
FIG. 1 is a schematic view of a first embodiment of an exemplary system according to the present invention.

FIG. 1 schematically illustrates a first embodiment of apparatus according to the present invention, for feeding comminuted cellulosic fibrous material (e.g. wood chips) to a continuous digester, and treating the wood chips to produce pulp, such as sulfate pulp, sulfite pulp, or the like.

The conventional components of the apparatus of FIG. 1 include the air lock 10 and chips bin 11 which receive chips from a source and then pass them through a chip meter 12 and low pressure feeder 13 into a horizontal steaming vessel 14, the chips being discharged into a chute 15 connected to a conventional high pressure feeder 18. A high pressure pump 19 is connected to one port of the high pressure feeder 18, while a low pressure pump 20 is connected to another port thereof. The pump 20 also is operatively connected to a sand separator 21, which in turn is connected to an in-line drainer 22. A level tank 23 and a pump 24 are also provided, and white liquor from a source 25 (or a like cooking liquor depending upon which pulping process is utilized) is ultimately entrained with the chips discharged by the high pressure feeder 18. Line 26 connected to the pump 24 leads to the top of an upright continuous digester, and white liquor is also added at one or more additional points to the digester 29, such as to line 27 connected through a pump to the line 28.

Additional conventional components of the system of FIG. 1 include the line 30 for circulating cellulosic fibrous material (chips) entrained in liquid to the top of the digester 29, at which point some of the liquid is separated from the chips/liquid slurry by the conventional top separator 31, and then is returned by the top circulation line 32 to the high pressure inlet pump 19 of the high pressure feeder 18. Heaters 33, 34, and 35 are provided for heating liquid withdrawn from various screens associated with the digester 29, which liquid is then circulated back to the digester 29 to effect cooking or the like. Also black liquor is withdrawn from the digester 29 and flashed in the first and second flash tanks 36, 37. An outlet device 38 discharges pulp from the bottom of the digester 29 into a discharge line 39, after which the pulp is passed on to subsequent treatment stages, such as washing, storage, and bleaching stages.

The conventional components of the system illustrated in FIG. 1 comprise a single vessel hydraulic "MCC" TM Kamyr, Inc. digester system. Since white liquor is added at different points in the system, the temperature of the slurry or liquid in the lines 30, 32 may increase undesirably so that it flashes into steam and causes hammering, and perhaps damage, in and to the high pressure feeder 18 and to line 30. In order to avoid this adverse consequence, according to the present invention the recirculating liquid in line 32 is cooled so that the temperature of the slurry in the high pressure feeder 18 and being fed in line 30 to the top of the digester 29 is low enough to avoid hydraulic hammering due to liquor flashing.

The apparatus (cooling means) for accomplishing the desired result according to the invention is shown generally within the dotted line box 42 in FIG. 1. It includes a conventional heat exchanger 43 through which the recirculating line 32 passes between the top separator 31 and the low pressure inlet pump 19 for the high pressure feeder 18. Coolant, which can be any available mill water, or cooler wash water from upstream brown stock washers or the like (e.g. liquid in route to recovery) or any process stream that could benefit from heating, passes through line 45 into heat exchange relationship with the hot liquor in the line 32, thereby significantly cooling the liquor in line 32. The coolant passes through an automatically controlled valve 46, controlled by flow controller 47, which receives input from the temperature indicator 48 operatively connected to the line 32. The temperature indicator 48 senses the temperature of the liquid being recirculated in line 32, and adjusts the flow of cooling liquid from coolant source 44 through valve 46, depending upon the sensed temperature. In this way, the temperature in the line 32 is lowered to the extent necessary to prevent hydraulic hammering, but yet is maintained high enough so that substantial amounts of energy are not wasted, or a great deal of additional energy need not be supplied to the chips to heat them to cooking temperature.

Figure 2:
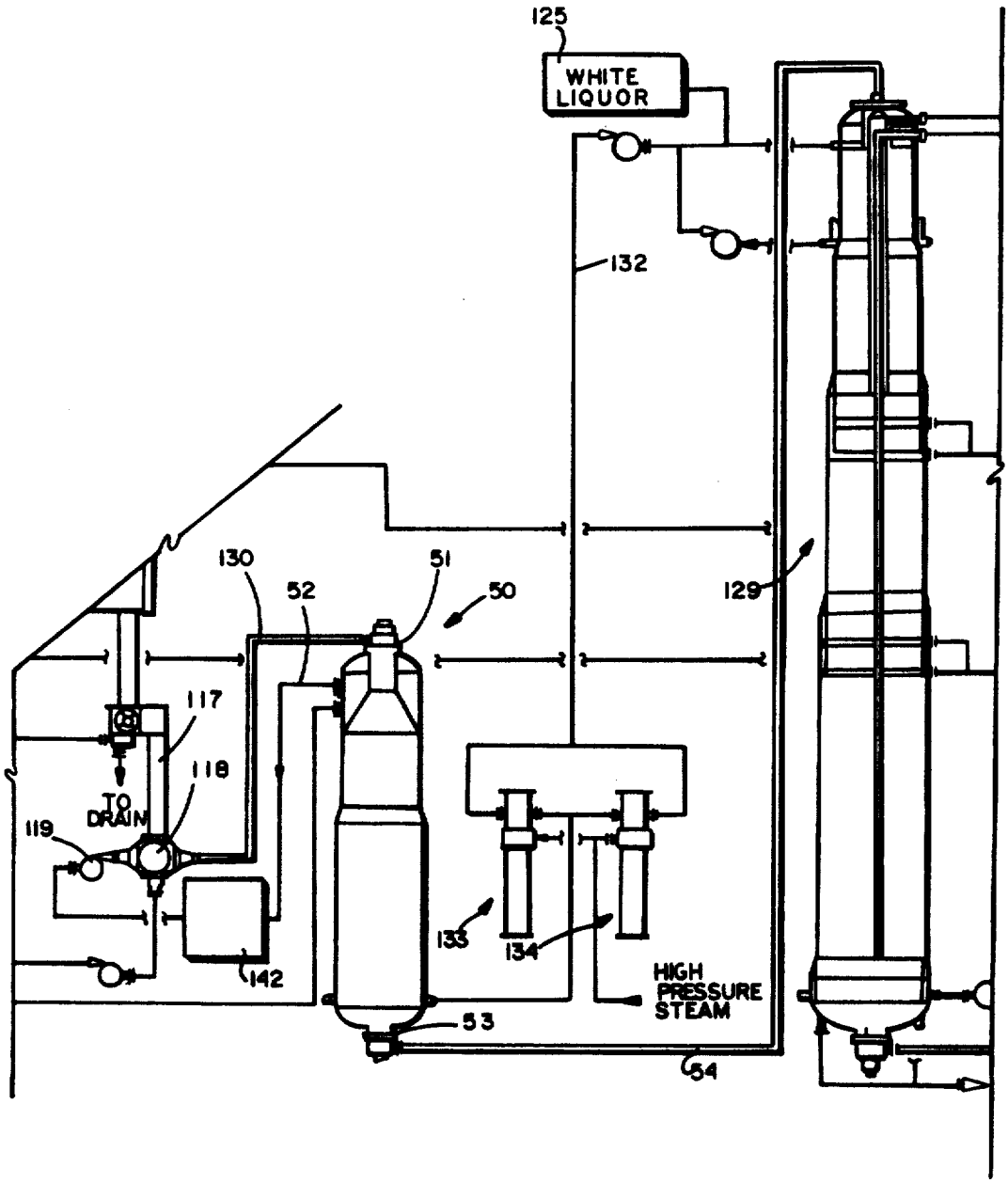
FIG. 2 is a schematic view of a modified form of the embodiment of FIG. 1.

The apparatus illustrated in FIG. 2 is the same as that illustrated in FIG. 1 except that it is for a two vessel hydraulic Kamyr MCC TM digester system. In the FIG. 2 embodiment components comparable to those in the FIG. 1 embodiment are illustrated by the same reference numeral only preceded by a "1".

The only significant difference in the embodiment of FIG. 2 is that a conventional impregnation vessel 50 is provided in the circulating and recirculating lines 130, 132. That is the circulating line 130 extends from the high pressure feeder 118 to the top separator 51 of the impregnation vessel 50, and recirculating liquid is withdrawn through line 52 at the top of the impregnation vessel 50. The chips slurry discharged by the outlet device 53 at the bottom of the impregnation vessel 50 passes the chips in circulating line 54 to the top of the digester 129, while liquid recirculated from the top of the digester 129 in line 132 passes back to the vessel 50. In this case, the high pressure feeder 118 is protected by the cooling mechanism 142 being provided in line 52, as illustrated in FIG. 2. That is the cooling means 142 (substantially identical to cooling means 42) is between the impregnation vessel 50 and the high pressure feeder 118 in the circulating and recirculating loops for supplying slurry to and withdrawing liquid from the continuous digester 129.

In addition to the apparatus according to the invention illustrated in FIGS. 1 and 2 (namely the cooling means 42, 142), according to the present invention another mechanism (FIG. 3) may be utilized for lowering the temperature of the liquids associated with the high pressure feeder 18, 118, and thereby avoiding hydraulic hammering. Alternatively, in some situations the cooling means 42, 142 may not be necessary and the mechanism illustrated in FIG. 3 may be used in its place.

Figure 3:
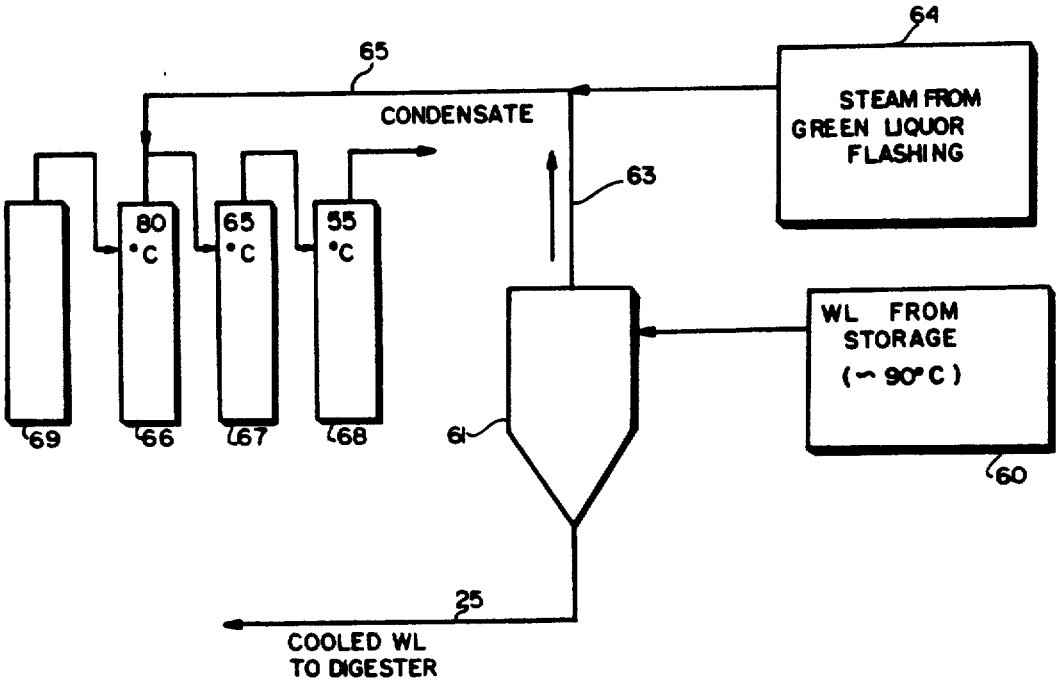
FIG. 3 is a schematic view of a system for cooling of white liquor by flashing the white liquor, according to another embodiment of the present invention.

FIG. 3 illustrates a mechanism for cooling the white liquor that is supplied to the chips that are passing in the circulating line to the top of the digester 29, 129, taking into account that the volume of this white liquor is much less than in conventional digesters (that is those without the MCC TM or EMCC ® process improvements of Kamyr, Inc.).

As illustrated in FIG. 3, hot white liquor from the pulp mill recausticization and white liquor storage facilities, typically at a temperature of about 90° C., is flashed in a conventional flash tank 61. The vacuum required for this flashing is provided by a vacuum pump in the attached evaporator. The flashed steam, at approximately 80° C., goes into line 63, while the cooled white liquor passes into line 25 (that is the cooled white liquor becomes the source of white liquor illustrated at the left hand bottom of FIG. 1). The temperature of the white liquor is reduced by at least 10° C. by flashing.

The steam in line 63 from flash tank 61 is combined with steam from green liquor flashing, or other steam sources, illustrated schematically at 64 in FIG. 3, and then passes via line 65 to a plurality of evaporators 66 through 69. Thus the steam from white liquor flashing is utilized to supplement the heat requirements of evaporators, such as the evaporators 66 through 69.

It will thus be seen according to the present invention that the temperature in the top circulation line of an MCC™ or EMCC® digester is controlled so as to avoid hydraulic hammering. While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent structures and methods.

What is claimed is:

1. A method of feeding comminuted cellulosic fibrous material to a continuous digester having a plurality of feed points for cooking liquor, utilizing a high pressure feeder, comprising the steps of:

(a) entraining comminuted cellulosic fibrous material in liquid to produce a slurry, and feeding the slurry to the top of the digester using the high pressure feeder;

(b) adding some cooking liquor to the slurry as part of the liquid entraining the material;

(c) separating some of the liquid from the slurry at the top of the digester;

(d) recirculating the separated out liquid from the top of the digester to the high pressure feeder; and (e) cooling the recirculating liquid so that the temperature of the slurry in the high pressure feeder and being fed to the top of the digester will be low enough to avoid hydraulic hammering due to liquor flashing.

2. A method as recited in claim 1 wherein step (e) is practiced by passing the liquid being recirculated into heat exchange relationship with a cooler liquid.

3. A method as recited in claim 2 comprising the further step of sensing the temperature of the liquid being recirculated, and adjusting the flow of cooling liquid dependent upon the sensed temperature.

4. A method as recited in claim 3 wherein step (b) is further practiced by cooling the cooking liquor before adding it to the slurry.

5. A method as recited in claim 1 wherein step (b) is further practiced by cooling the cooking liquor before adding it it to the slurry.

6. A method as recited in claim 5 wherein step (b) is further practiced by flashing the cooking liquor, to cook it, prior to adding it to the slurry, and to produce flashed steam.

7. A method as recited in claim 6 wherein step (b) is further practiced to reduce the temperature of the cooking liquor by at least about 10° C.

8. A method as recited in claim 6 wherein step (b) is practiced using white liquor as the cooking liquor.

9. A method as recited in claim 8 wherein the temperature of the white liquor prior to flashing is about 90° C.

10. A method as recited in claim 6 comprising the further step of using the flashed steam in an evaporator.

11. A method of feeding comminuted cellulosic fibrous material to a continuous digester having a plurality of feed points for cooking liquor, utilizing a high pressure feeder, comprising the steps of:

(a) entraining comminuted cellulosic fibrous material in liquid to produce a slurry, and feeding the slurry to the top of the digester using the high pressure feeder;

(b) adding some cooking liquor to the slurry as part of the liquid entraining the material;

(c) separating some of the liquid from the slurry at the top of the digester;

(d) recirculating the separated out liquid from the top of the digester to the high pressure feeder; and (e) controlling the temperature of slurry in the high pressure feeder and being fed to the top of the digester so that it is low enough to avoid hydraulic hammering due to liquor flashing by cooling the cooking liquor prior to adding said liquor to the slurry in step (b).

12. A method as recited in claim 11 wherein step (e) is further practiced by flashing the cooking liquor, to cool said liquor, prior to adding said liquor to the slurry, and to produce flashed steam.

13. A method as recited in claim 12 wherein step (e) is further practiced to reduce the temperature of the cooking liquor by at least about 10° C.

14. A method as recited in claim 12 wherein step (e) is practiced using white liquor as the cooking liquor.

15. A method as recited in claim 14 wherein the temperature of the whiter liquor prior to flashing is about 90° C.

16. A method as recited in claim 12 comprising the further step of using the flashed steam in an evaporator.

* * * * *